US005324033A

United States Patent [19]

Fenton, Jr.

[11] Patent Number: 5,324,033

[45] Date of Patent: Jun. 28, 1994

[54] FLUTED HOSEL FOR A GOLF CLUB

[75] Inventor: Francis A. Fenton, Jr., South Hadley, Mass.

[73] Assignee: Fenton Golf, Inc., Sarasota, Fla.

[21] Appl. No.: 67,697

[22] Filed: May 26, 1993

[51] Int. Cl.[5] ..... A63B 53/02

[52] U.S. Cl. ..... 273/80.2; 273/80.3; 273/167 E; 273/167 F; 273/169

[58] Field of Search ..... 273/80.1, 80.2, 80.3, 273/80.4, 80.5, 80.6, 80.7, 80.8, 80.9, 77 R, 167 R, 167 E, 169, 167 F

[56] References Cited

U.S. PATENT DOCUMENTS

| | | | |
|---|---|---|---|
| 125,455 | 2/1841 | Newsome . | |
| 247,824 | 5/1878 | Meissler . | |
| 1,266,529 | 5/1918 | Mattern . | |
| 1,396,470 | 11/1921 | Taylor | 273/167 E |
| 1,695,291 | 12/1928 | Muller | 273/80.3 |
| 1,778,122 | 10/1930 | Pedersen | 273/80.3 |
| 1,892,482 | 12/1932 | Cash, Jr. . | |
| 1,985,427 | 12/1934 | Richardson . | |
| 3,582,081 | 6/1971 | Caplan . | |
| 4,065,133 | 12/1977 | Gordos | 273/167 E |

FOREIGN PATENT DOCUMENTS

| | | | |
|---|---|---|---|
| 210073 | 8/1957 | Australia | 273/80.2 |
| 0000538 | 1/1977 | Japan | 273/167 E |
| 322635 | 12/1929 | United Kingdom . | |
| 371974 | 5/1932 | United Kingdom | 273/167 F |
| 1078412 | 8/1967 | United Kingdom | 273/167 E |
| 2012597 | 8/1979 | United Kingdom | 273/167 E |

*Primary Examiner*—Vincent Millin
*Assistant Examiner*—Sebastiano Passaniti
*Attorney, Agent, or Firm*—Richard H. Kosakowski

[57] ABSTRACT

A golf club has a clubhead with a neck portion, or "hosel", integrally formed therewith. The hosel has a generally cylindrical shape with a corresponding cylindrical concentric bore hole formed in a portion of the hosel. One or more depressions of a predetermined shape are formed in the outer surface of the hosel wall material by selectively removing portions of the hosel wall material. The depressions are formed to a depth that does not penetrate the entire thickness of the hosel wall material. This leaves the entire inner surface of the hosel wall material available for adhesion to a golf club shaft inserted into the hosel bore hole. The depressions may be in the form of fluted slots or hemispherical dots, and may be disposed at predetermined locations around the circumference of the outer surface of the hosel wall material.

18 Claims, 2 Drawing Sheets

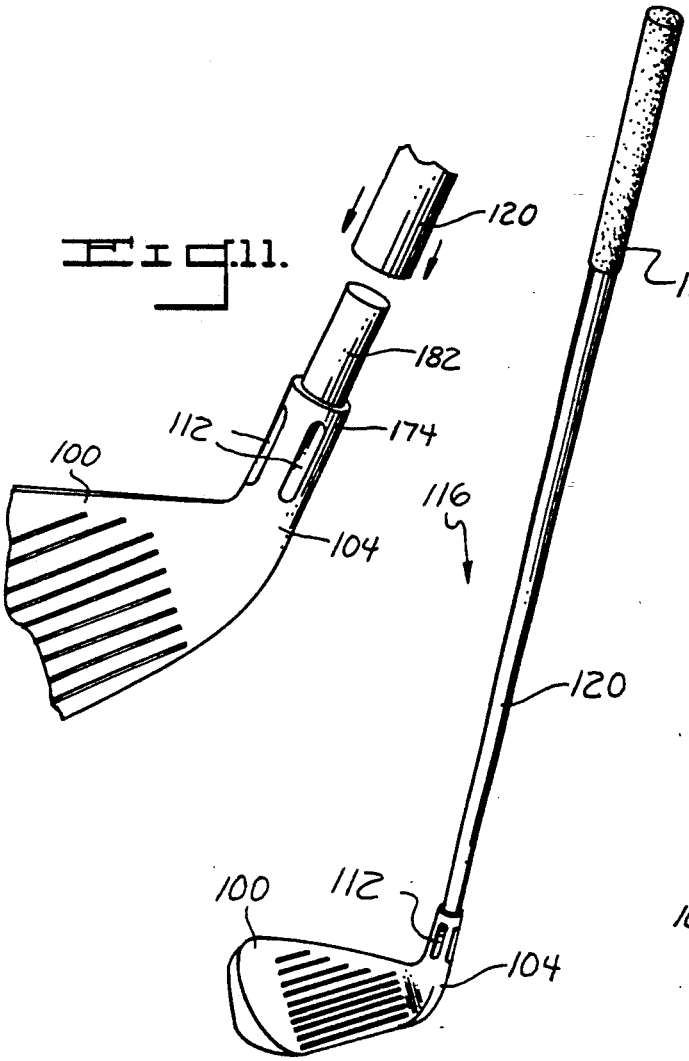
Fig.1.
Fig.11.
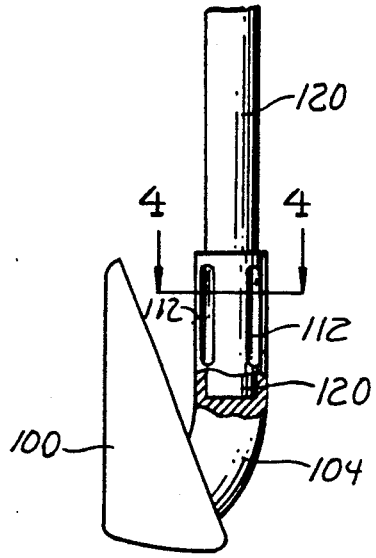
Fig.3.
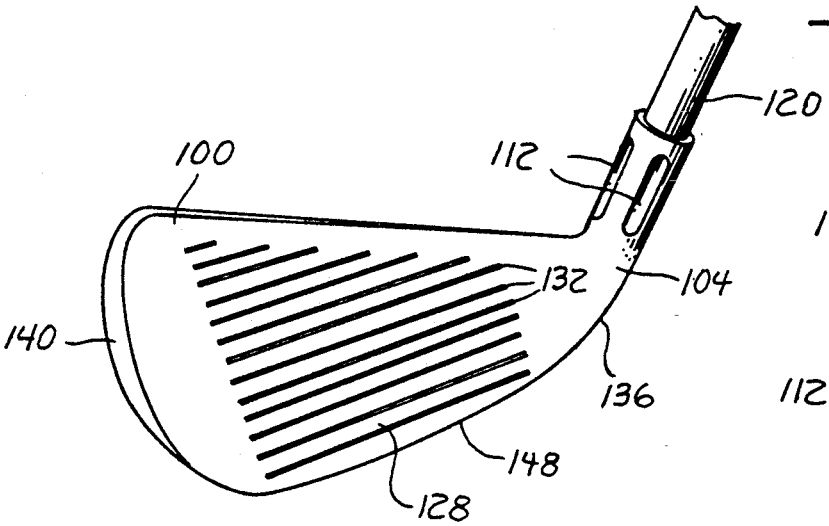
Fig.2.
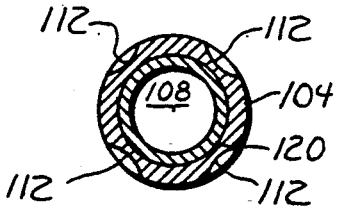
Fig.4.

FLUTED HOSEL FOR A GOLF CLUB

BACKGROUND OF THE INVENTION

This invention relates to golf clubs, and more particularly to a golf club having a neck portion or "hosel" that has selected portions of the hosel outer wall material removed, resulting in a plurality of depressions formed in the hosel wall.

In the prior art of golf clubs (either "woods" or "irons"), it is known to form a clubhead with an integral hosel portion. The hosel has a bore hole formed internal to the hosel material. The bore hole may be formed through the entire length of the hosel (i.e., a "through-bore"), or may be formed through only a portion of the hosel (i.e., a "blind bore"). The hosel is formed at an angle with respect to the bottom, or "sole", of the clubhead. This angle is referred to as the "lie" angle of the club. The bore hole in the hosel is operable to receive an end of the shaft of the golf club. The shaft is secured to the clubhead within the hosel by one or more of a number of means, including pins and/or adhesives. It is critical that the means employed in securing the shaft to the clubhead within the hosel be of high integrity so as to withstand relatively large torsional strains placed thereon due to the impact of the clubhead with the gold ball.

In the early part of the 20th century, golf clubs are constructed with heads and wooden shafts. The wooden shafts were secured within bores in the hosels of the clubheads by means of adhesives, and often times reinforced by one or more transverse pins. Relative to modern-day hosels, these early hosels where much longer and had a much larger outside diameter. Holes were drilled clear through the hosel material to facilitate placement of the pins through the entire diameter of the wooden shaft. Further, slots or holes were formed clear through the hosel material. It was discovered that the wood shaft would swell over time into the slots, thereby helping to secure the shaft to the hosel. See, for example, U.S. Pat. No. 1,266,529 to Mattern.

However, problems with this type of shaft-to-clubhead connection included the fact that the holes in the hosel allowed the adhesive to seep out of the hosel, and further allowed moisture to get into the wood of the shaft, thereby degrading the integrity of the connection. Also, the wooden shaft tended to dry out and shrink in warmer temperatures, creating a loose fit of the shaft within the hosel. The loose fit permitted a large amount of torsional forces at impact of the clubhead with the ball to be absorbed by the pin. Over time, this caused cracks in the shaft.

Later, when metal shafts were developed, it was still known to "pin" the shaft to the hosel. It was further known to form slots clear through the hosel material to provide resiliency to the aforementioned torsional force at impact of the clubhead with the golf ball. The slots were formed on the hosel below the point where the pin was located. See for example, U.S. Pat. No. 1,892,482 to Cash, Jr. As taught in this patent, the shaft was not fixedly attached to the hosel below the point where the pin was attached. Thus, the shaft was allowed to swivel to a limited extent with respect to the hosel. However, in such a connection, the pin absorbed the major portion of the torsional force at impact of the clubhead with the ball.

The United States Golf Association ("USGA") is golf's governing body in the United States. The USGA has strict and "rigid" rules that specify, inter alia, the physical characteristics of a golf club. Included among the rules is one that specifies that the mass or weight of the club must remain constant during the round of golf. Thus, a golfer cannot just "blindly" add mass or weight to the clubhead during play in an effort, for example, to increase the moment of inertia to thereby reduce the effects of "off center" shots. Instead, the club designer must recognize the location, within the clubhead, of unnecessary or undesirable mass or weight that may be available for repositioning in a more useful area of the clubhead. It has long been recognized that the hosel adds unnecessary and undesirable weight to the clubhead. This is why modern clubheads have hosels that are relatively smaller in outside diameter and shorter in length, as compared to the prior art.

Alternatively, it is known in the modern art to design a clubhead with no hosel whatsoever. This is true for clubs of the "metal wood" type. The no-hosel design entirely removes the weight of the hosel and allows the weight to instead be placed in the clubhead, where it is more desirable and beneficial.

The no-hosel design is not without its drawbacks, however. Firstly, eliminating the hosel largely reduces the amount of area available inside the clubhead for bonding to the outside of the shaft. This causes problems over time due to the aforementioned torsional strain placed on the interface of the clubhead with the shaft. In the no-hosel design, this large amount of torsional strain is distributed along a much smaller amount of the tip of the shaft. Such large amount of strain may exceed the strength of materials used on some composite shafts.

Another problem with the no-hosel design lies in the fact that a different sensation, or "feel", is experienced by the golfer when the club is swung. In other words, the golfer tends to perceive that the balance of the club is "off" (i.e., is much different then what the golfer is accustomed to using with a traditional clubhead having a hosel).

A further problem with the no-hosel design is that the clubshaft has lost some of its normal "kick" or spring. This is because the shaft designers attempt to build up the walls of the shaft, or they insert other materials in the tip of the shaft to protect the shaft from breaking off at the clubhead.

In light of the foregoing, it is accordingly a primary object of the present invention to provide a golf clubhead with a hosel having an internal bore hole for receiving an end of a shaft, and having selected portions of the hosel wall material surrounding the bore hole removed to reduce the weight of the hosel.

It is a general object of the present invention to simultaneously reduce the weight of a hosel and redistribute the weight to the remainder of the clubhead where it is more beneficial.

It is a further object of the present invention to provide a reduced weight hosel with ample inner surface material to allow for proper adherence of the shaft within the hosel, thus allowing for proper and adequate support of the shaft within the hosel.

It is yet another object of the present invention to provide a hosel that allows a golf club manufacturer to use a normal golf club shaft that does not require the clubhead end of the shaft to be reinforced before the shaft is inserted into the hosel.

It is yet another object of the present invention to provide a hosel that provides for proper "feel" and "balance" of the golf club to a golfer as the club is swung.

The above and other objects and advantages of this invention will become more readily apparent when the following description is read in conjunction with the accompanying drawings.

SUMMARY OF THE INVENTION

To overcome the deficiencies of the prior art and to achieve the objects listed above, Applicant has invented an improved, reduced weight hosel for a golf club having selected portions of the hosel outer wall material removed to form a plurality of depressions in the hosel wall material.

In the preferred embodiment, a golf club of the type of either an "iron", "metal wood" or "putter" has a clubhead with a neck portion or "hosel" integrally formed therewith. The hosel has a generally cylindrical shape with a corresponding cylindrical concentric bore hole formed in a portion of the hosel so as to leave a predetermined and uniformly thick amount of hosel "wall" material remaining that completely encircles the inner bore hole. One or more depressions of a predetermined shape are formed in the outer surface of the hosel wall material by selectively removing portions of the hosel wall material. The depressions are formed to a depth that does not penetrate the entire thickness of the hosel wall material. Thus, the entire inner surface of the hosel wall material is available for adhesion to the golf club shaft that is inserted into the hosel bore hole. The depressions may be slotted or hemispherical in form, and may be disposed at predetermined locations around the circumference of the outer surface of the hosel wall material. The resulting portions of hosel wall material selectively removed represent an amount of mass or weight of the clubhead that may be distributed to other portions of the clubhead for more beneficial use.

In an alternative embodiment, the hosel has a first cylindrical portion that rises up from the clubhead. The depressions are formed in an outer surface of this first hosel portion. Integral with this first hosel portion and disposed thereabove is a second "male" hosel portion of diameter smaller than that of the first portion. In contrast to the preferred embodiment, no bore hole is formed in either hosel portion in this alternative embodiment. Instead, the shaft of the golf club fits over the second "male" hosel portion and is secured thereto.

BRIEF DESCRIPTION OF THE DRAWINGS

FIG. 1 is a perspective view of a golf club having a clubhead with a hosel formed according to the present invention;

FIG. 2 is a close-up perspective view of the head portion of the golf club of FIG. 1;

FIG. 3 is a toe-end view of the clubhead of FIG. 2 having slots formed in the hosel portion of the clubhead in accordance with the present invention;

FIG. 4 is a cross-section view of the clubhead of FIG. 3 taken along lines 4—4 of FIG. 3;

FIG. 11 is a close-up perspective view of an alternative embodiment of a "male"-type hosel having the depressions formed therein according to the present invention.

DETAILED DESCRIPTION OF THE PREFERRED EMBODIMENTS

Figure 5:
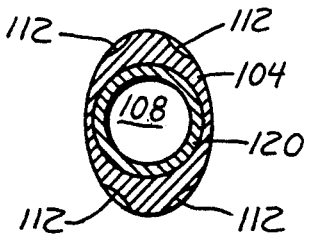
FIG. 5 is a cross-section view of an alternative embodiment of the hosel portion of the clubhead of FIG. 3 taken along lines 4—4 of FIG. 3.

Referring to the drawings in detail, an improved head for either an "iron", "wood" or "putter"-type of golf club is illustrated and generally designated by the reference number 100. The head 100 has a hosel portion 104 integrally formed therewith. The hosel 104 has a bore hole 108 formed in a portion of the hosel 104 so as to leave a predetermined amount of hosel wall material that completely encircles the inner bore hole 108. One or more depressions 112 of a predetermined shape, for example, slots or hemispheres, are formed in the outer surface of the hosel wall material by selectively removing portions of the hosel wall material. The depressions 112 are formed to a depth that does not exceed the entire thickness of the hosel wall material.

FIG. 1 illustrates in perspective an "iron"-type golf club 116 having a clubhead 100, a shaft 120 and a grip 124. In FIG. 2 is illustrated in more detail the clubhead 100 of the club 116 of FIG. 1. The clubhead for the "iron"-type of club 116 has a striking face 128 for contacting a golf ball (not shown). The striking face 128 typically has a plurality of grooves 132 formed therein. The clubhead 100 also comprises heel 136 and toe 140 portions, along with top 144 and sole 148 portions.

Integrally formed with the clubhead 100 and rising from the heel 136 portion of the head 100 is a neck or "hosel" 104 of the clubhead 100. The hosel 104 has a plurality of depressions 112 formed therein in accordance with the present invention. The hosel 104 is generally cylindrical in shape at its top portion. The hosel 104 also has an inner bore hole 108 formed normally concentric to the cylindrical axis of the hosel 104. As seen in greater detail hereinafter, the bore hole 108 extends down a predetermined portion of the hosel 104 and is operable to receive an end of the golf club shaft 120. The head 100 may be formed by any one of a number of known methods, including, without limitation, casting, investment casting, forging, milling, molding, etc. The method used to form the head 100 is irrelevant to the present invention.

Referring now to FIG. 3, there illustrated is a toe-end view of the "iron"-type of clubhead 100. The pair of depressions 112 visible in FIG. 3 are of a shape referred to as a "fluted slot". In the preferred embodiment of the present invention, four fluted slots 112 are formed in the hosel outer wall material and spaced evenly around the circumference of the hosel outer wall material.

Referring also to FIG. 4, modern day hosels 104 are typically cylindrical in shape and have an outside diameter of approximately 0.500 inches. An inner bore hole 108 is formed in the hosel 104 to a predetermined depth (i.e., a "blind bore"). The bore hole 108 secures an end of the shaft 120 of FIG. 1 to the clubhead 100. The bore hole 108 is formed concentric to the hosel's cylindrical shape; i.e., the center axis of the bore hole 108 is aligned (coaxial) with the center axis of the hosel 104. The depth of the bore hole 108 in a preferred embodiment of the invention is 1.125 inches. The bore hole 108 has a diameter of 0.376 inches, which results in a wall thickness of 0.062 inches. The fluted slots 112 are formed with a length of 0.605 inches, and are spaced evenly from the top and bottom of the bore hole 108. With a bore hole depth of 1.125 inches, the top and bottom spacing for the fluted slots 112 is 0.260 inches.

In FIG. 4 (which is not drawn to scale), the shape of each fluted slot 112 and its position relative to the outer wall material of the hosel 104 can be seen in greater detail. In the preferred embodiment of the present invention, each flute 112 is circular in cross-section and reaches a depth of 0.015 inches. The width of each flute 112 is 0.100 inches. As can be seen in FIG. 4, the flutes 112 are formed so as to not penetrate the entire thickness of the wall of the hosel 104. That is, with a wall thickness of 0.062 inches, the 0.015 inch depth of each flute results in only about a one-quarter depth of penetration of the hosel wall thickness. This is in contrast to the aforementioned prior art wherein the slots were formed clear through the wall material. By providing slots 112 that do not penetrate the entire thickness of the hosel wall material, the present invention allows the tip of the shaft 120 to be properly supported within the bore hole 108 of the hosel 104.

The primary purpose for forming such fluted slots 112 in the outer wall of the hosel 104 is to remove unnecessary mass from the hosel 104 and allow the mass to be placed on other portions of the clubhead 100 where it is more beneficial.

As described hereinbefore, the typical hosel 104 is cylindrical in shape throughout the majority of the length of the hosel. However, it is to be understood that the hosel 104 may instead be of other shapes, such as elliptical, as seen in FIG. 5. FIG. 5 is a similar cross-section view as that illustrated in FIG. 4, with the exception that FIG. 5 illustrates an elliptical hosel 104. The major axis of the ellipse is parallel to the longitudinal plane of the clubface 128. That is, the minor axis of the ellipse is parallel to the desired line of flight of the ball leaving the clubface 128.

It is to be understood that the locations on the hosel outer wall material of the fluted slots 112 are purely exemplary. The slots 112 may be formed with any desired size and placement on the outer hosel wall material, in light of the teachings herein. It suffices for the present invention that one or more depressions 112 be formed in the hosel wall material to a depth such that each depression does not degrade the integrity of the interface of the shaft 120 within the bore hole 108 of the hosel 104 by forming the depressions 112 clear through the hosel wall material. It is to be further understood that the fluted slot shape of the depressions 112 is also purely exemplary. Other shapes may be used, without limitation, in light of the teachings herein.

Figure 6:
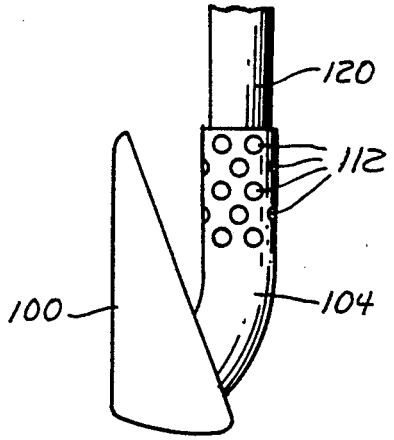
FIG. 6 is a toe-end view of a clubhead having a hosel portion with depressions formed therein in accordance with an alternative embodiment of the present invention.

For example, FIG. 6 illustrates a toe-end view of a clubhead 100 similar to that in FIG. 3, with the exception that a plurality of hemispherical "dots" 112 are formed in the hosel wall material. The "dots" 112 are formed in five "rows" encircling the circumference of the hosel 104. The dots 112 are shown staggered between rows. However, it is to be understood that such placement of the dots 112 is purely exemplary and is shown as such without limitation. In a similar manner to the fluted slots 112 described hereinbefore, the dots 112 may be formed by known methods of machining; for example, milling the depressions out of the outer hosel wall material.

Figure 7:
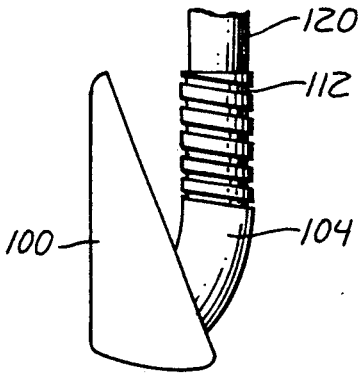
FIG. 7 is a toe-end view of a clubhead having a hosel with a portion of the hosel material removed in accordance with yet another alternative embodiment of the present invention.
Figure 8:
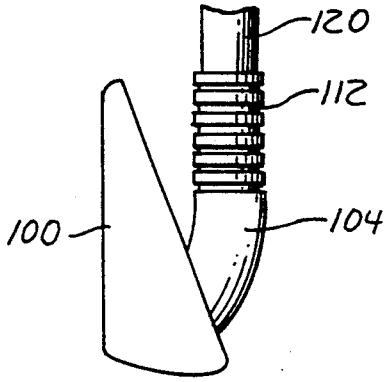
FIG. 8 is a toe-end view of a clubhead having a hosel with a portion of the hosel material removed in accordance with still another embodiment of the present invention.

FIGS. 7 and 8 illustrate further alternative embodiments of the present invention in which various shapes of depressions are formed in the hosel outer wall material. In these and in the foregoing exemplary embodiments of the present invention, the depressions 112 are always formed such that they do not exceed the entire depth of thickness of the hosel wall material. In FIG. 7 is illustrated a toe-end view of the clubhead 100 with a hosel 104 having a continuous spiral depression 112 formed in the hosel outer wall material. FIG. 8, on the other hand, illustrates the hosel 104 having a series of circular "grooves" or channels 112 formed in the hosel wall material.

Figure 9:
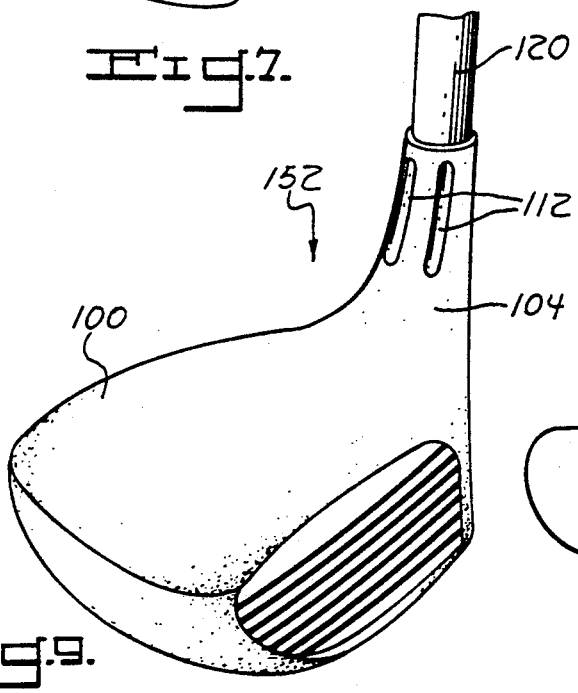
FIG. 9 is a perspective view of a clubhead of a "wood"-type golf club having a hosel portion with slots formed in the hosel in accordance with the present invention.
Figure 10:
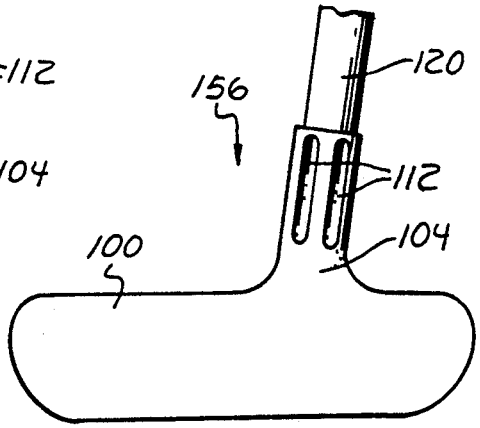
FIG. 10 is a perspective view of a clubhead for a "putter"-type golf club having a hosel with a number of slots formed in the hosel in accordance with the present invention.

It is to be understood that the invention is not limited to the aforementioned "iron"-type of golf club 116. The present invention may be utilized on a hosel 104 which is integral with the head 100 of various other types of golf clubs. For example, FIG. 9 illustrates a perspective view of a head 100 of a "wood"-type golf club 152; specifically, that of the "metal wood"-type of club 152. In a similar manner to the clubhead 100 of FIGS. 1–8, the hosel 104 of the metal wood clubhead 100 has a bore hole 108 disposed in a portion of the hosel 104 for receiving and securing a shaft 120 of the club 116 therewithin. FIG. 9 illustrates the hosel outer wall as having a plurality of fluted slots 112 formed therein in a similar manner to that illustrated in FIG. 3. Again, the purpose of such slots 112 is to remove unnecessary and undesirable weight from the hosel 104 and redistribute such weight to the clubhead 100 where it is more beneficial to the performance to the golf club 152. FIG. 10 illustrates in perspective the head 100 of a "putter"-type of golf club 156 having a plurality of fluted slots 112, similar to those of FIGS. 3 and 9, formed in the hosel 104 of the putter clubhead 100. In contrast to the clubhead 100 for the iron 116 or wood 152 golf clubs described hereinbefore, the hosel is not required by USGA rules to emanate from (i.e., rise up from) the heel 136 of the clubhead 100. Instead, although not shown in every instance, the hosel may rise up from the toe 140 of the clubhead 100, or from some point between the heel 136 and toe 140.

As mentioned hereinbefore, the present invention is not limited to the specific shapes shown in the drawings herein. The depressions 112 formed in the outer wall of the hosel material may take on other shapes known or hereinafter contemplated. For example, the shapes may be in the form of stars, crescents, ovals, cylinders or any other shape. Further, the placement of the depressions 112 may be different then that shown herein. For example, the slots 112 may be formed at an orientation with respect to the hosel 104 other than longitudinally as illustrated in FIG. 3.

As illustrated in the figures, the internal bore hole 108 formed in the hosel is cylindrical and is shown concentric to the cylindrical outer circumference of the hosel as in FIG. 4. However, it is to be understood that instead the axis of the bore hole 108 may be eccentric to the axis of either the cylindrical hosel 104 of FIG. 4 or the elliptical hosel 104 of FIG. 5.

Further, the invention has been described for use with a hosel 104 having an internal bore hole 108. As such, the shaft 120 of the golf club 116 is inserted into the bore hole. However, it is to be understood that the depressions 112 may be utilized on a hosel 104 in which the shaft 120 instead fits over a solid "male" portion of the hosel 104, as illustrated in FIG. 11. That is, the hosel 104 of FIG. 11 has a first portion 174 that is generally cylindrical or elliptical in shape, into which the depressions 112 of the present invention are formed. Integral with and disposed above the first hosel portion 174 is a second "male" portion 182, generally cylindrical in shape and of a diameter smaller than that of the first portion 174. The second portion 182 rises to a predetermined distance above the top of the first hosel portion 174. No bore hole is formed in either the first or second hosel portions, in contrast to the preferred embodiment described hereinbefore with respect to FIGS. 1–10. Instead, the shaft 120 has an internal bore hole (not shown) that fits over the second "male" portion 182 of the hosel 104 (as indicated by the directional arrowheads) for securing the shaft to hosel by, e.g., adhesives.

In this alternative "shaft-over-hosel" design illustrated in FIG. 11, the clubhead 100 is for an "iron"-type of golf club 116, similar to that of FIGS. 1–8. However, it is to be understood that the "shaft-over-hosel" design may be utilized on male hosels 104 formed on either "wood" or "putter"-type golf clubs 152, 156 respectively, of the type illustrated in FIGS. 9 and 10.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. A head portion of a golf club, comprising:
a. a striking face;
b. a heel;
c. a toe;
d. a sole; and
e. a hosel integrally connected with the head, the hosel having a bore formed down through a portion of the hosel such that a wall portion of the hosel surrounds the bore, as characterized by at least one depression formed in an outer surface of the hosel wall, the depression being formed in the hosel at a depth of the thickness of the hosel wall that is less than the entire thickness of the hosel wall, the wall portion of the hosel surrounding the bore being of uniform thickness, the depression being in the form of a fluted slot having a longitudinal dimension oriented parallel to an axis of the bore formed in the hosel, the depth of penetration of the slot into the hosel wall being up to one-quarter of the overall thickness of the hosel wall, the slot being evenly spaced on the outer hosel wall between the top of the hosel and a point on the hosel that equals the depth of the bore formed in the hosel, each depression being spaced equidistantly around the circumference of the hosel wall outer surface, whereby each depression allows a predetermined amount of mass of the head portion of the golf club to be redistributed from the hosel to other portions of the head where it is more beneficial..

2. The head of claim 1, wherein the golf club comprises an iron-type club.

3. The head of claim 1, wherein the golf club comprises a wood-type club.

4. The head of claim 1, wherein the golf club comprises a putter.

5. The head of claim 1, wherein the hosel has a generally cylindrical cross-sectional shape.

6. The head of claim 1, wherein the hosel has a generally elliptical cross-sectional shape.

7. In a golf club having a shaft and a head portion to which the shaft is attached, the head having a striking face, a heel, a toe, a sole and a hosel integrally connected with the head, the hosel having a bore formed therein to a predetermined depth of the head portion such that a wall portion of the hosel surrounds the bore, wherein the improvement comprises at least one depression formed in an outer surface of the hosel wall and at a predetermined depth of a thickness of the hosel wall, the wall portion of the hosel surrounding the bore being of uniform thickness, the depression being in the form of a fluted slot having a longitudinal dimension oriented parallel to an axis of the bore formed in the hosel, the depth of penetration of the slot into the hosel wall being up to one-quarter of the overall thickness of the hosel wall between the top of the hosel and a point on the hosel that equals the depth of the bore formed in the hosel, each depression being spaced equidistantly around the circumference of the hosel wall outer surface, whereby each depression allows a predetermined amount of mass of the head portion of the golf club to be redistributed from the hosel to other portions of the head where it is more beneficial.

8. The golf club of claim 7, wherein the golf club comprises an iron-type club.

9. The golf club of claim 7, wherein the golf club comprises a wood-type club.

10. The golf club of claim 7, wherein the golf club comprises a putter.

11. The golf club of claim 7, wherein the hosel has a generally cylindrical cross-sectional shape.

12. The golf club of claim 7, wherein the hosel has a generally elliptical cross-sectional shape.

13. A head portion of a golf club, comprising:
a. a striking face;
b. a heel;
c. a toe;
d. a sole; and
e. a hosel integrally connected with the head, the hosel having a first portion rising from the head, the hosel having a second portion integral with the first portion and disposed above the first portion, the second portion being of a smaller cross-sectional thickness than the first portion, as characterized by at least one depression formed in an outer surface of the first portion of the hosel, the depression being formed at a depth of the thickness of the first portion of the hosel that is less than the entire thickness of the first portion of the hosel, the depression being in the form of a fluted slot having a longitudinal dimension oriented parallel to an axis of the hosel, the depth of penetration of the slot into the first portion of the hosel being up to one-quarter of the overall thickness of the hosel, the first portion of the hosel having the slot formed therein being of uniform thickness, each depression being spaced equidistantly around the circumference of the hosel, whereby each depression allows a predetermined amount of mass of the head portion of the golf club to be redistributed from the hosel to other portions of the head where it is more beneficial.

14. The head of claim 13, wherein the golf club comprises an iron-type club.

15. The head of claim 13, wherein the golf club comprises a wood-type club.

16. The head of claim 13, wherein the golf club comprises a putter.

17. The head of claim 13, wherein the hosel has a generally cylindrical cross-sectional shape.

18. The head of claim 13, wherein the hosel has a generally elliptical cross-sectional shape.

* * * * *